US008791968B2

(12) United States Patent
Weng et al.

(10) Patent No.: US 8,791,968 B2
(45) Date of Patent: Jul. 29, 2014

(54) SOURCE DRIVER FOR DRIVING AT LEAST ONE SUB-PIXEL

(71) Applicant: Himax Technologies Limited, Tainan (TW)

(72) Inventors: Meng-Tse Weng, Tainan (TW); Chuan-Che Lee, Tainan (TW); Chin-Tien Chang, Tainan (TW); Chien-Ru Chen, Tainan (TW)

(73) Assignee: Himax Technologies Limited, Tainan County (TW)

( * ) Notice: Subject to any disclaimer, the term of this patent is extended or adjusted under 35 U.S.C. 154(b) by 0 days.

(21) Appl. No.: 14/083,522

(22) Filed: Nov. 19, 2013

(65) Prior Publication Data

US 2014/0085357 A1 Mar. 27, 2014

Related U.S. Application Data

(62) Division of application No. 12/457,741, filed on Jun. 19, 2009.

(51) Int. Cl.
*G09G 3/36* (2006.01)

(52) U.S. Cl.
USPC ..... 345/690

(58) Field of Classification Search
USPC ..... 345/87–100, 204, 211–212, 690–691; 341/144, 145
See application file for complete search history.

(56) References Cited

U.S. PATENT DOCUMENTS 5,539,406 A * 7/1996 Kouno et al. ..... 341/155
6,256,025 B1 7/2001 Imai et al.
6,459,399 B1 10/2002 Nozaki
6,492,970 B1 * 12/2002 Furuhashi et al. ..... 345/94
6,680,685 B2 1/2004 Nozaki
7,227,560 B2 6/2007 Kudo et al.
7,382,306 B2 6/2008 Takahashi
7,394,705 B2 7/2008 Kwack (Continued)

FOREIGN PATENT DOCUMENTS

CN 1901021 A 1/2007
TW 583524 4/2004
TW 200908700 A 2/2009

OTHER PUBLICATIONS

English translation of abstract of TW (published Apr. 11, 2004). TW-583524-B.

(Continued)

*Primary Examiner* — Rodney Amadiz
(74) *Attorney, Agent, or Firm* — McClure, Qualey & Rodack, LLP

(57) ABSTRACT

A source driver for driving at least one sub-pixel is disclosed, in which the source driver includes a gamma voltage generator and a digital to analog converter. The gamma voltage generator generates a plurality of gamma voltages, in which the gamma voltage generator includes a first gamma resistor string and an operation circuit. The first gamma resistor string includes a plurality of resistors electrically connected serially for dividing a first gamma reference voltage and a second gamma reference voltage into the gamma voltages. The operation circuit optionally adds increments to the gamma voltages according to a timing control signal, wherein the increments are the same when the gamma voltages are added. The digital to analog converter selecting one of the gamma voltages generated by the operation circuit as a driving voltage based on received digital pixel data.

6 Claims, 5 Drawing Sheets

(56) References Cited

U.S. PATENT DOCUMENTS

| | | | | |
|---|---|---|---|---|
| 7,623,125 | B2 | 11/2009 | Harada | |
| 7,675,352 | B2 | 3/2010 | Lin et al. | |
| 7,696,967 | B2 | 4/2010 | Lee | |
| 7,932,876 | B2 | 4/2011 | Jo et al. | |
| 7,940,286 | B2 | 5/2011 | Pan et al. | |
| 8,044,903 | B2 * | 10/2011 | Sun | 345/89 |
| 8,441,505 | B2 * | 5/2013 | Chen | 345/690 |
| 2002/0063674 | A1 | 5/2002 | Chiang | |
| 2003/0011548 | A1 | 1/2003 | Nakajima | |
| 2003/0151617 | A1 | 8/2003 | Morita | |
| 2006/0023001 | A1 | 2/2006 | Sung et al. | |
| 2007/0018922 | A1 | 1/2007 | Lee et al. | |
| 2007/0188430 | A1 | 8/2007 | Moon | |
| 2007/0257942 | A1 | 11/2007 | Kudo et al. | |
| 2007/0279364 | A1 | 12/2007 | Moh | |
| 2008/0150874 | A1 | 6/2008 | Kida et al. | |
| 2009/0040158 | A1 | 2/2009 | Chuang | |
| 2011/0175877 | A1 | 7/2011 | Weng | |

OTHER PUBLICATIONS

English translation of abstract of TW 200908700 (published Feb. 16, 2009).

English translation of abstract of CN 1901021 A (published Jan. 24, 2007).

* cited by examiner

SOURCE DRIVER FOR DRIVING AT LEAST ONE SUB-PIXEL

RELATED APPLICATIONS

The present application is a divisional of U.S. application Ser. No. 12/457,741, filed on Jun. 19, 2009, which is herein incorporated by reference.

BACKGROUND

1. Field of Invention

The present invention relates to a source driver. More particularly, the present invention relates to a source driver for a display system.

2. Description of Related Art

A liquid crystal display (LCD) is a device which displays images by controlling transmittance of incident light emitted from a light source using optical anisotropy of liquid crystal molecules and polarization characteristics of a polarizer. Recently, the application of LCD has expanded since lightweight, slim size, high resolution and large screen size can be implemented in LCD which have low power consumption.

In general, LCD have a narrow viewing angle as compared to other display devices because light is transmitted only along a light transmitting axis of liquid crystal molecules to display images. Various technologies to improve the viewing angle of an LCD have been studied. One of the technologies is aligning liquid crystal molecules perpendicular to a substrate, forming a cutout or protrusion pattern respectively on a pixel electrode and a common electrode facing the pixel electrode, in which distorting an electric field between the two electrodes forms multi-domain structure and improves the viewing angle.

Although such method shows better contrast, however, the visibility, the viewing angle, the cross talk phenomenon, and particularly the side-visibility is still unacceptable.

SUMMARY

According to one embodiment of the present invention, a source driver for driving at least one sub-pixel is disclosed. The source driver includes a gamma voltage generator and a digital to analog converter.

The gamma voltage generator generates a plurality of gamma voltages. The gamma voltage generator includes a gamma resistor string, a second resistor, a plurality of first switches, and a second switch. The gamma resistor string includes a plurality of first resistors electrically connected serially to divide a first gamma reference voltage and a second gamma reference voltage, in which the first resistors have first ends and second ends providing gamma voltages. The second resistor has a first end electrically connected to the gamma resistor string and a second end receiving a third gamma reference voltage. The first switches are uniformly conducted to the first ends or the second ends of the first resistors according to a timing control signal for passing the gamma voltages. The second switches optionally connected to the first end or the second end of the second resistor according to the timing control signal.

The digital to analog converter selects one of the gamma voltages passed by the first switches as a driving voltage based on received digital pixel data.

According to another embodiment of the present invention, another source driver for driving at least one sub-pixel is disclosed. The source driver includes a gamma voltage generator and a digital to analog converter. The gamma voltage generator, generating a plurality of gamma voltages, includes a plurality of resistors electrically connected serially for dividing a first gamma reference voltage and a second gamma reference voltage into the gamma voltages, and an operation circuit optionally adding increments to the gamma voltages according to a timing control signal, in which the increments are the same.

The digital to analog converter selects one of the gamma voltages generated by the operation circuit as a driving voltage based on received digital pixel data.

According to still another embodiment of the present invention, the source driver for driving at least one sub-pixel is disclosed. The source driver includes a gamma voltage generator and a digital to analog converter. The gamma voltage generator includes a gamma resistor string, a plurality of first resistors electrically connected serially for dividing a first gamma reference voltage, and a plurality of second resistors electrically connected serially for dividing a second gamma reference voltage, in which the voltage drop across each second resistor is the same as the voltage drop across each corresponding first resistor. The gamma resistor string includes a plurality of third resistors electrically connected serially for generating a plurality of gamma voltages. The first selector electrically connects one of the first resistors to a first end of the gamma resistor string. The second selector electrically connects one of the second resistors to a second end of the gamma resistor string.

The digital to analog converter selects one of the gamma voltages generated by the gamma resistor string as a driving voltage based on received digital pixel data.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
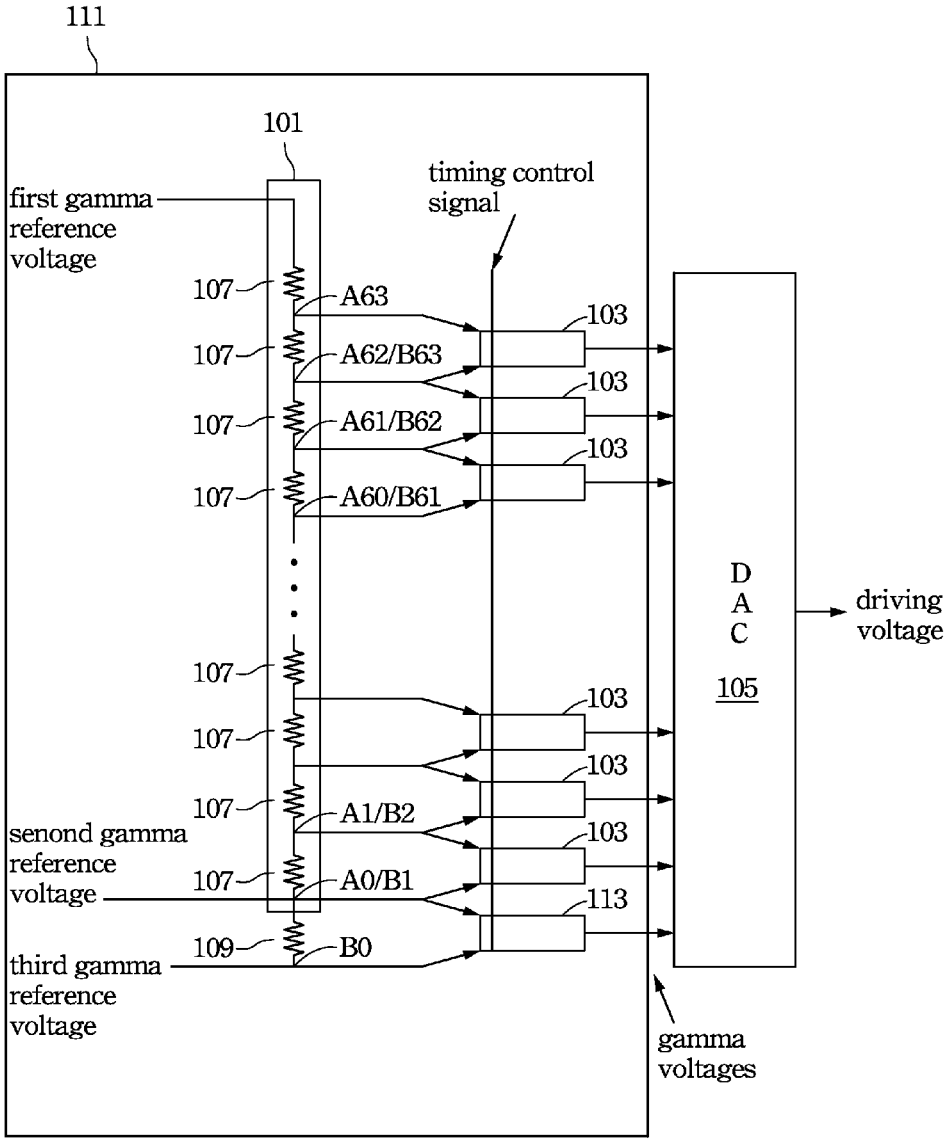
FIG. 1 shows the gamma voltage generator and the digital to analog converter of the source driver according to one embodiment of the present invention.

Reference will now be made in detail to the present embodiments of the invention, examples of which are illustrated in the accompanying drawings. Wherever possible, the same reference numbers are used in the drawings and the description to refer to the same or like parts.

To improve the visibility, the viewing angle, the color shift, the cross talk phenomenon, and particularly the side-visibility of the LCD, some method such as 1G-2D, 1G-1D is utilized. These methods form a plurality of pixel regions in a sub-pixel, drive them independently, and apply different voltage to the respective divided pixel regions. Thereby, the viewing angle, the color shift, the cross talk phenomenon, and the side-visibility can be improved, since pixel regions are charged with different levels of voltage and the light transmitting axis of the liquid crystal molecule is controlled in various directions. Therefore, a gamma voltage generator is required for generating gamma voltages with different levels.

FIG. 1 shows the gamma voltage generator and the digital to analog converter of the source driver according to one embodiment of the present invention. The source driver, driving at least one sub-pixel, includes the gamma voltage generator 111 and the digital to analog converter 105. The gamma voltage generator 111 generates plenty of gamma voltages, then the digital to analog converter 105 selects one of the gamma voltages as a driving voltage based on received digital pixel data.

The gamma voltage generator 111, generating the gamma voltages, includes a gamma resistor string 101 which has a first end receiving the first gamma reference voltage, and also has a second end, electrically connected to the second resistor 109, receiving the second gamma reference voltage. The gamma resistor string 101 includes several first resistors 107 electrically connected serially for dividing a first gamma reference voltage and the second gamma reference voltage, in which the first resistors 107 have first ends A63~A0 and second ends B63~B0 providing gamma voltages. The resistances of the first resistors 107 are the same, so that the voltage drops across each first resistors 107 are the same.

The second resistor 109 has a first end A0 electrically connected to the gamma resistor string 101 and a second end B0 receiving a third gamma reference voltage, in which the resistance of every first resistors 107 and the resistance of the second resistor 109 are the same, such that the voltage drop across each first resistor 107 and the voltage drop across the second resistor 109 are the same.

The total number of the first resistors 107 and the second resistors 109 correspond to the bit number of each data line channel. For example, if each data channel has 6 bits, then the total number of first resistor 107 should be $2^6=64$, which is approximately the number of gamma voltages.

The first switches 103 are uniformly conducted to the first ends A63, A62 . . . A1, or the second ends B63, B62, . . . B1 of the first resistors 107 according to a timing control signal for passing the gamma voltages. The second switch 113 also optionally connects to the first end A0 or the second end B0 of the second resistor 109 according to the timing control signal. Therefore, the gamma voltages are divided as two groups according to the timing control signal, and each gamma voltage of one group is different to the corresponding gamma voltage of the other group. For example, if the second gamma reference voltage is the floating voltage and the third gamma reference voltage is 0 Volt, then the first gamma voltage group might be 64 v, 63V, 62V . . . 1V, and the other gamma voltage group might be 63V, 62V, 61V . . . 0V. Thus, the driving voltage can drive the first pixel region and the second pixel region of each sub-pixel with different voltage values alternatively and sequentially. In detail, the driving voltage drives the first pixel region of the sub-pixel before drives a second pixel region of the sub-pixel in every driving cycle.

Figure 2A:
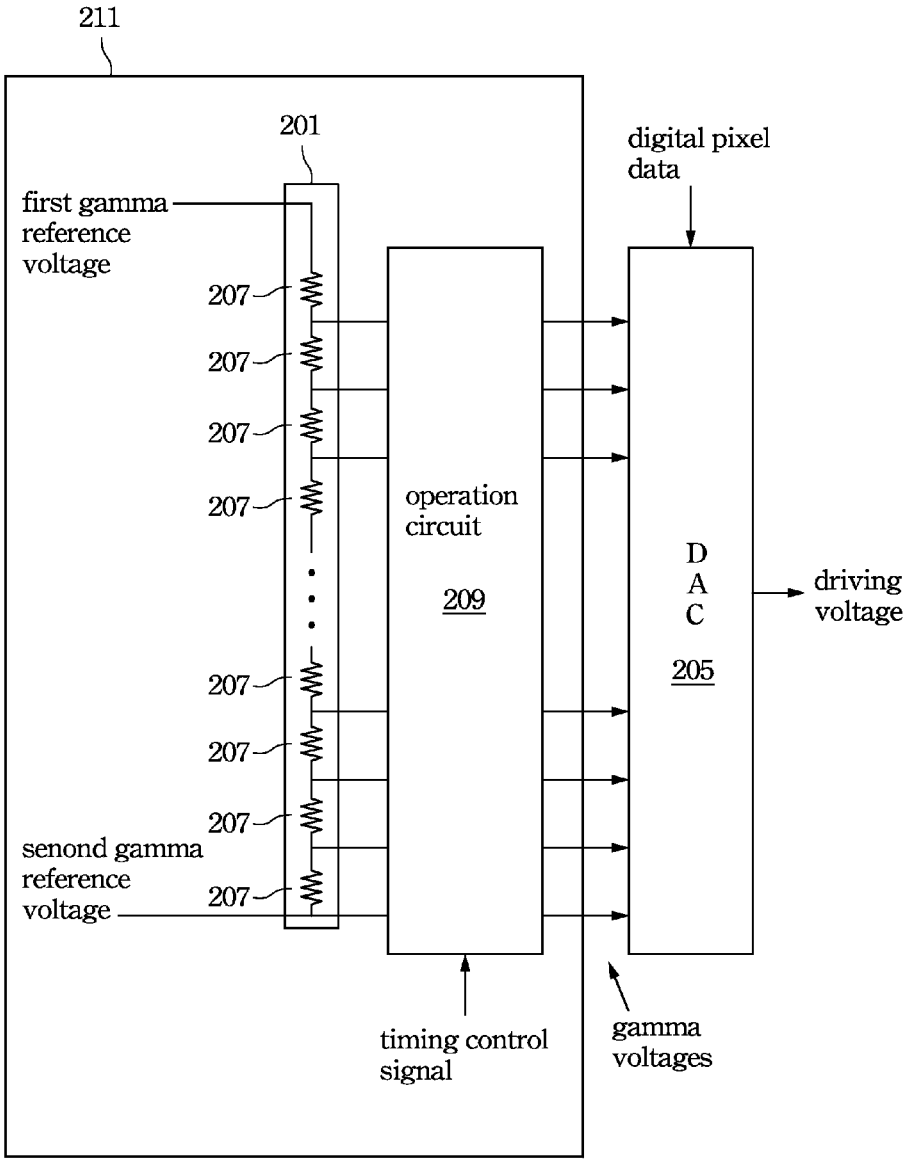
FIG. 2A shows the gamma voltage generator and the digital to analog converter of the source driver according to another embodiment of the present invention.

FIG. 2A shows the gamma voltage generator and the digital to analog converter of the source driver according to another embodiment of the present invention. The source driver, driving at least one sub-pixel, includes a gamma voltage generator 211 for generating a lot of gamma voltages, and a digital to analog converter 205 selecting one of the gamma voltages generated by the operation circuit 209 as the driving voltage based on received digital pixel data.

The gamma voltage generator 211 includes a first gamma resistor string 201 and an operation circuit 209. The first gamma resistor string 201 includes a lot of resistors 207 electrically connected serially for dividing the first gamma reference voltage and the second gamma reference voltage into the gamma voltages, in which the number of the gamma voltages is corresponding to bit number of a data line channel. The resistances of the resistors 207 are the same, so that the voltage drops across each first resistor 207 are the same.

Figure 2B:
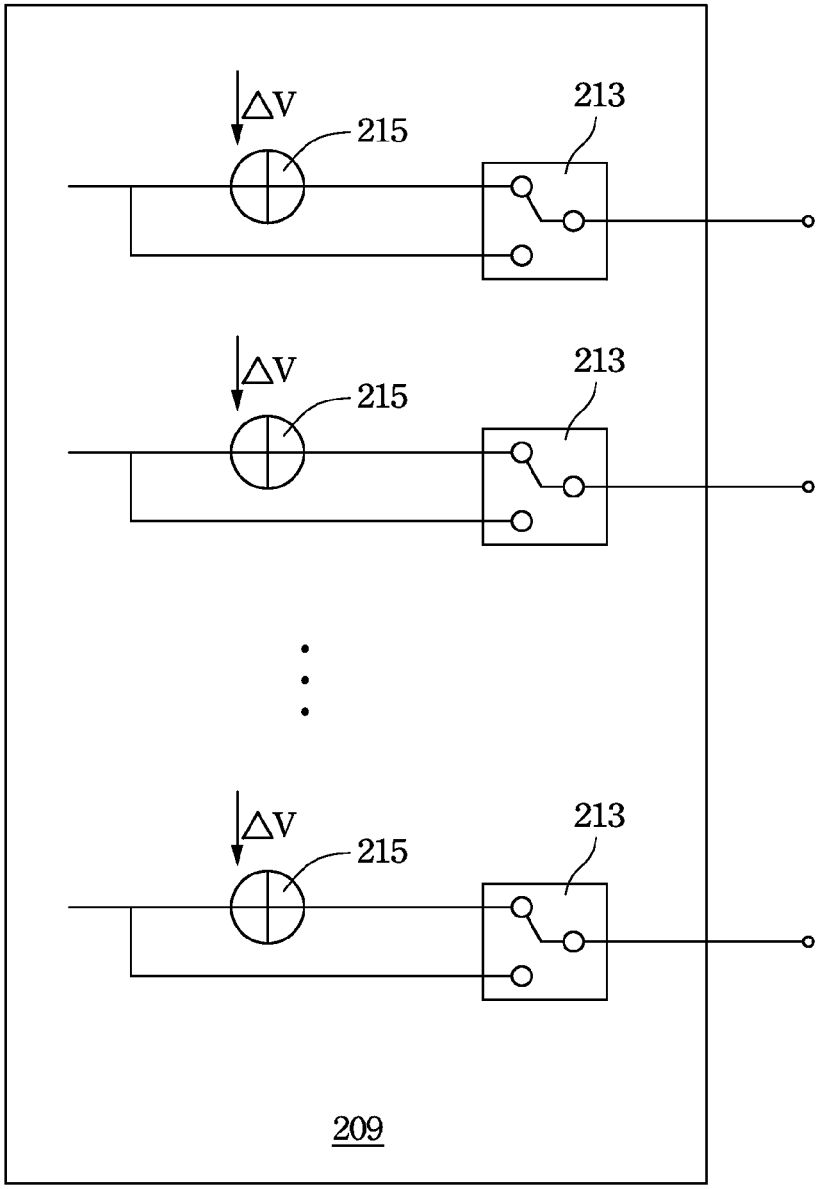
FIG. 2B shows the operation circuit of the gamma voltage generator according to the embodiment of the present invention.

FIG. 2B shows the operation circuit of the gamma voltage generator according to the embodiment of the present invention. The operation circuit 209 optionally adds increments to the gamma voltages according to the timing control signal, in which all the increments are the same when the gamma voltages are added. The increments added to the gamma voltages can be all positive or all negative at the same time. For example, if the increments are all +1 V, then all gamma voltages are added with +1V at the same time.

The operation circuit 209 includes a lot of adders 215 for adding the gamma voltages, and also includes a lot of selectors 213 selecting the un-added gamma voltages or the added gamma voltages uniformly according to the timing controller signal. For example, the adders 215 can all add +1V to the gamma voltages, and all the selectors 213 can choose the added gamma voltages; or all the selectors 213 can choose the original gamma voltages without the increments. Therefore, the gamma voltages are divided as the added group and the un-added group according to the timing control signal, thus the driving voltage can drive the first pixel region and the second pixel region of each sub-pixel with different voltage value alternatively and sequentially.

Figure 3:
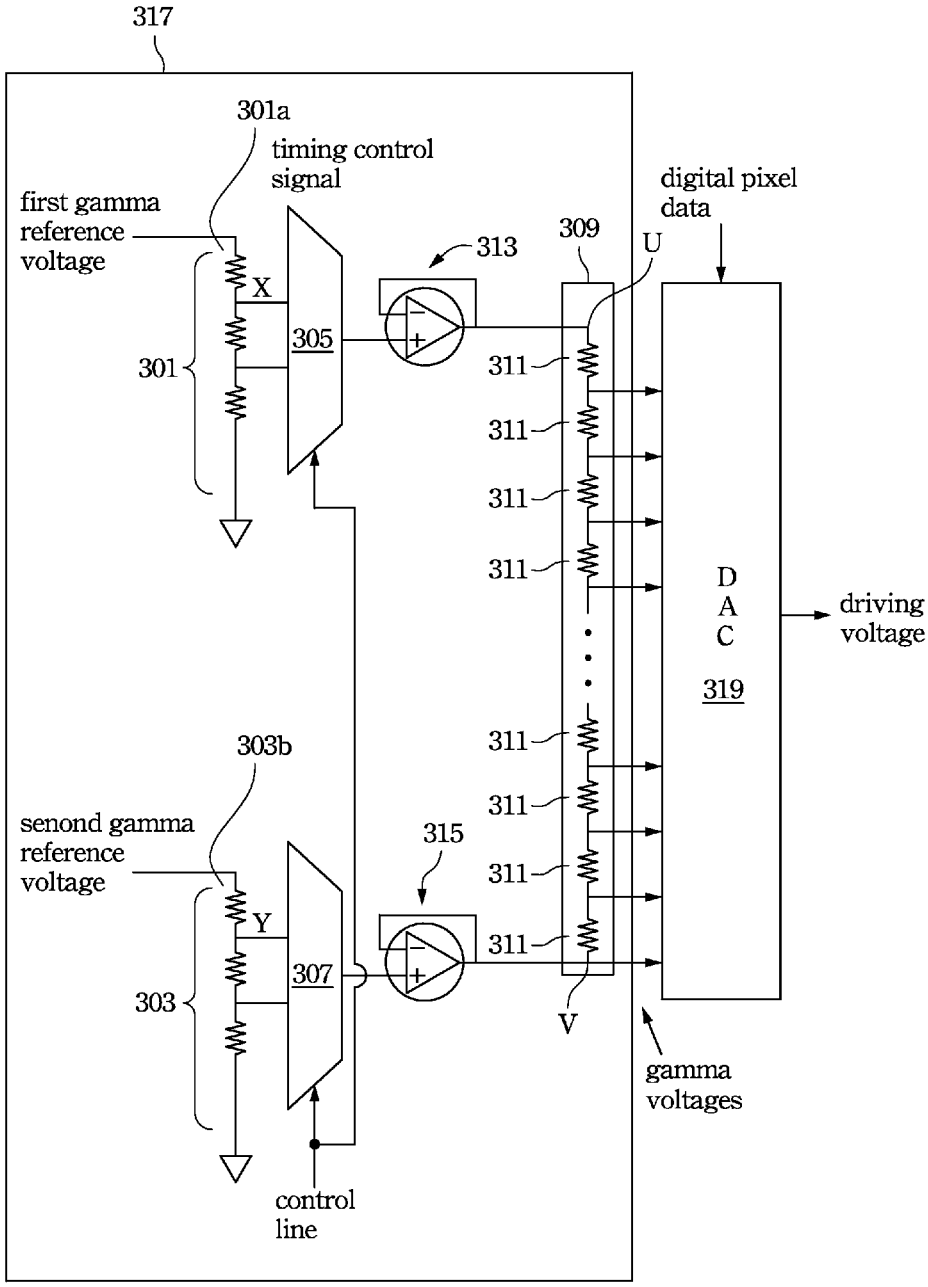
FIG. 3 shows the gamma voltage generator and the digital to analog converter of the source driver according to still another embodiment of the present invention.

FIG. 3 shows the gamma voltage generator and the digital to analog converter of the source driver according to still another embodiment of the present invention. The source driver, driving at least one sub-pixel, includes a gamma voltage generator 317 for driving the gamma voltages, and also includes a digital to analog converter 319 selecting one of the gamma voltages generated by the gamma resistor string 309 as a driving voltage based on received digital pixel data.

The gamma voltage generator 317 includes the first resistors 301, the second resistors 303, the gamma resistor string 309, a first selector 305, and a second selector 307. The first resistors 301 are electrically connected serially for dividing the first gamma reference voltage. The second resistors 303 are electrically connected serially for dividing the second gamma reference voltage, in which the voltage drop across each second resistor 303 is the same as the voltage drop across each corresponding first resistor 301. In this embodiment, the voltage value of the first gamma reference voltage is greater than the voltage value of the second gamma reference voltage.

The 1 bit control line controls the first selector 305 and the second selector 307 for passing the divided first gamma reference voltage and the divided second gamma reference voltage uniformly. For example, if the control line makes the first selector 305 pass the gamma voltage on terminal X of the first resistor 301*a*, then the control line will also make the second selector 307 pass the gamma voltage on terminal Y of the second resistor 303*b* which is corresponding to the first resistor 301*a*. With such controlling, the driving voltage can drive the first pixel region or the second pixel region of each sub-pixel with different voltage values alternatively.

The gamma resistor string 309 includes third resistors 311 electrically connected serially for generating the gamma voltages, and the number of the gamma voltages is corresponding to bit number of a data line channel. The first selector 305 is electrically connecting one of the first resistors 301 to a first end U of the gamma resistor string 309, and the second selector 307 is electrically connecting one of the second resistors 303 to a second end V of the gamma resistor string 309.

The gamma voltage generator 317 further includes a first unity gain buffer 313 and a second unity gain buffer 315 in order to drive the gamma resistor string 309 more effectively. The first unity gain buffer 313 is electrically connected between the first selector 305 and the first end U of the gamma resistor string 309. The second unity gain buffer 315 is electrically connected between the second selector 307 and the second end V of the gamma resistor string 309.

Figure 4:
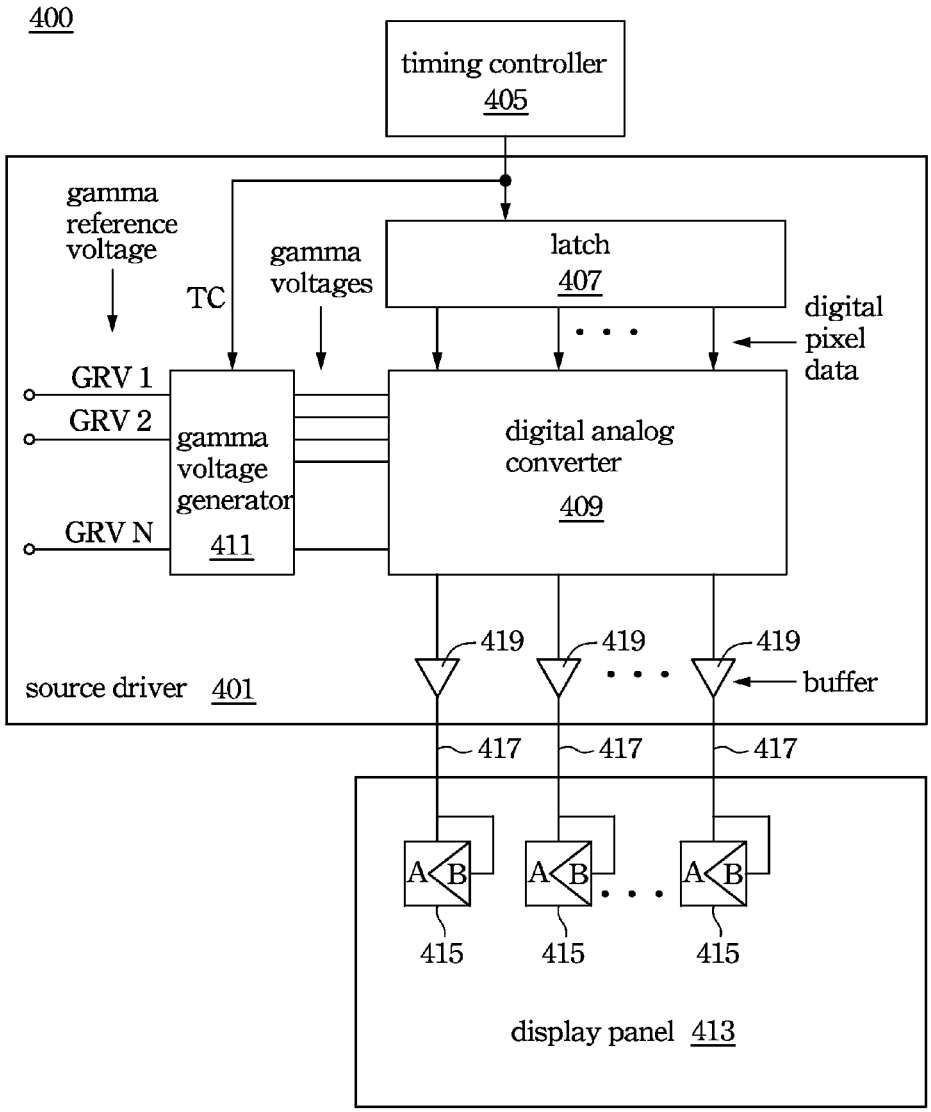
FIG. 4 shows the display system according to one embodiment of the present invention.

FIG. 4 shows the display system according to one embodiment of the present invention. The display system 400 includes a source driver 401, a timing controller 405 generating the digital pixel data and the timing control signal TC, and a display panel 413 having a lot of sub-pixels 415 driven by the driving voltages on data lines 417.

The source driver 401 includes the gamma voltage generator 411 and the digital to analog converter 409. The gamma voltage generator 411 generates a lot of gamma voltages for driving the first pixel regions A or the second pixel regions B of the sub-pixels 415 alternatively according to the timing control signal TC, in which the gamma voltage generator 411 generally divides some of the gamma reference voltage GRV1, GRV2 . . . GRVN for generating the gamma voltages. Then the digital to analog converter 409 selects some of the gamma voltages as the driving voltages based on received digital pixel data. The source driver 401 further includes a latch circuit 407 and buffers 419. The latch circuit 407 is electrically connected to the digital to analog converter 409, in which the latch circuit 407 stores and passes the digital pixel data for the digital to analog converter 407. The buffers 419 enhance the driving capability of the data line 417 to drive the sub-pixels 415.

The display panel 413 includes lots of sub-pixels 415 driven by driving voltages on data lines 417. The sub-pixels 415 can be red light sub-pixels, green light sub-pixels, or blue light sub-pixels. The sub-pixels 415 of the display panel 413 includes a lot of first pixel regions A driven by the driving voltages corresponding to one group of gamma voltages, and a lot of second pixel regions B driven by the driving voltages corresponding to another group of gamma voltages, in which the voltage values of the two group gamma voltage are different. Therefore, the first pixel regions A and the second pixel regions B of the sub-pixels 415 can be driven by driving voltages with different voltage value alternatively and sequentially.

According to the above embodiments, each of the sub-pixels is divided as at least two pixel regions, and the source driver can drive the pixel regions with different voltages alternatively and sequentially, which improves the visibility, particularly the side-visibility of the LCD.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A source driver for driving at least one sub-pixel, the source driver comprising:

a gamma voltage generator for generating a plurality of gamma voltages, the gamma voltage generator comprising:

a first gamma resistor string comprising a plurality of resistors electrically connected serially for dividing a first gamma reference voltage and a second gamma reference voltage into the gamma voltages;

and an operation circuit optionally adding increments to the gamma voltages according to a timing control signal, wherein the increments are the same when the gamma voltages are added; and a digital to analog converter selecting one of the gamma voltages generated by the operation circuit as a driving voltage based on received digital pixel data.

2. The source driver for driving at least one sub-pixel as claimed in claim 1, wherein the operation circuit comprises:

a plurality of adders for adding the gamma voltages; and a plurality of selectors selecting the un-added gamma voltages or the added gamma voltages uniformly according to the timing controller signal.

3. The source driver for driving at least one sub-pixel as claimed in claim 2, wherein the number of the gamma voltages is corresponding to bit number of a data line channel.

4. The source driver for driving at least one sub-pixel as claimed in claim 1, wherein the resistances of the resistors are the same.

5. The source driver for driving at least one sub-pixel as claimed in claim 1, wherein the increments are negatives.

6. The source driver for driving at least one sub-pixel as claimed in claim 1, wherein the driving voltage drives a first pixel region or a second pixel region of the sub-pixel alternatively.

* * * * *